United States Patent [19]

Denmark et al.

[11] 4,432,579

[45] Feb. 21, 1984

[54] CARRIERS FOR CONTAINERS

[76] Inventors: James Denmark, 5 York Pl., Leeds, England, LS1 2SD; John Shilcock, 11 Wendron Close, Roberttown, Liversedge, West Yorkshire, England

[21] Appl. No.: 293,933

[22] Filed: Aug. 18, 1981

[30] Foreign Application Priority Data

Sep. 19, 1980 [GB] United Kingdom ..... 8030433
Feb. 19, 1981 [GB] United Kingdom ..... 8015383

[51] Int. Cl.[3] ..... B65D 71/00; B66F 19/00
[52] U.S. Cl. ..... 294/87.2; 206/158
[58] Field of Search ..... 294/87.2, 87.22, 87.26, 294/87.28; 206/427, 153, 158, 148, 199, 146, 147, 149, 152

[56] References Cited

U.S. PATENT DOCUMENTS 2,950,041 8/1960 Stone ..... 206/158
3,528,697 9/1970 Wood ..... 294/87.2
3,767,041 10/1973 Graser ..... 294/87.2

*Primary Examiner*—James B. Marbert

*Attorney, Agent, or Firm*—Fred Philpitt

[57] ABSTRACT

The invention provides a holding device for one or more rows of bottles or the like. The device comprises essentially a sleeve of sheet material having upper and lower walls and side walls, and the device is applied to the containers by passing it over the containers so that the tops pass through apertures in the base wall and then apertures in the top wall. The containers are locked to the device by virtue of the device having locking tabs or a locking wall which folds upwardly by virtue of engagement with the containers, but locks under the container rims or beads on the caps of the containers or at the container mouths, preventing removal of the container by movement in an opposite direction. Preferably, there are two locking devices which engage the container rims or beads at opposite sides, and lie in an inclined position relative to the container axis.

The sleeve is preferably of rectangular or square cross section so that it can be displaced to flattened form about crease lines lying at a pair of opposite corners, for transportation.

9 Claims, 37 Drawing Figures

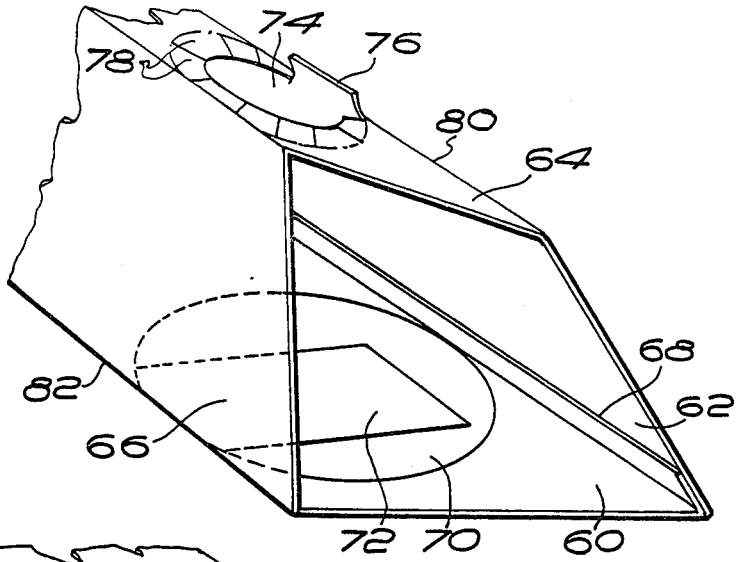
FIG. 6
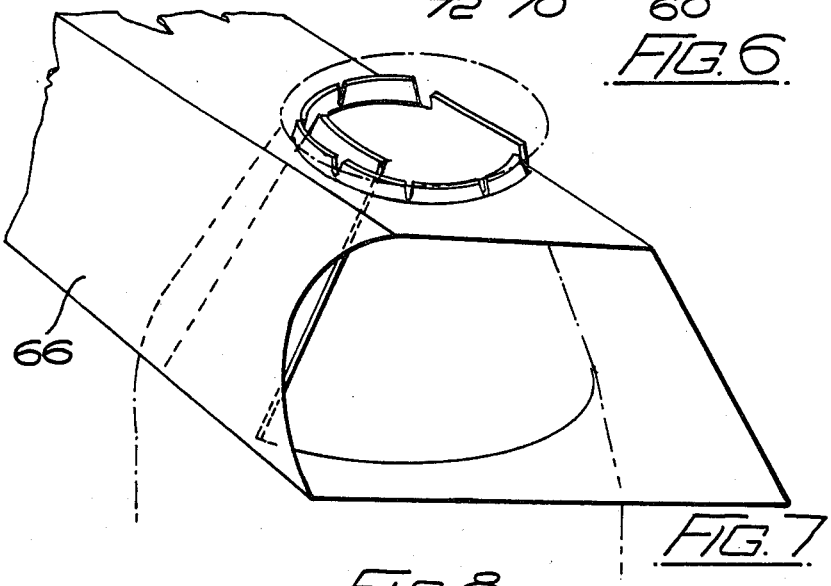
FIG. 7
FIG. 8
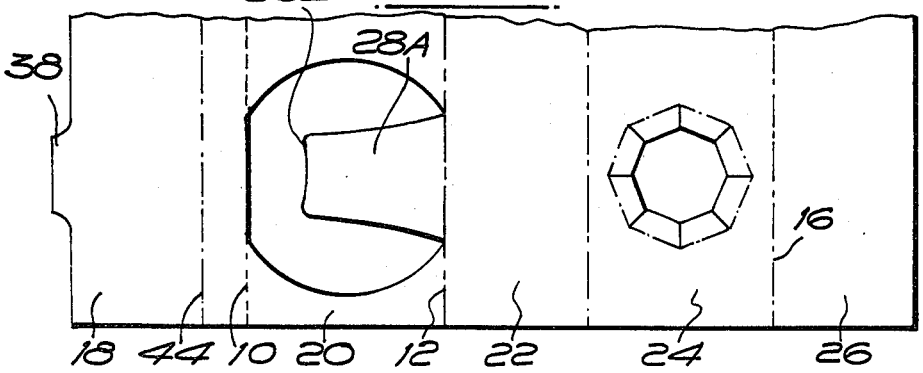

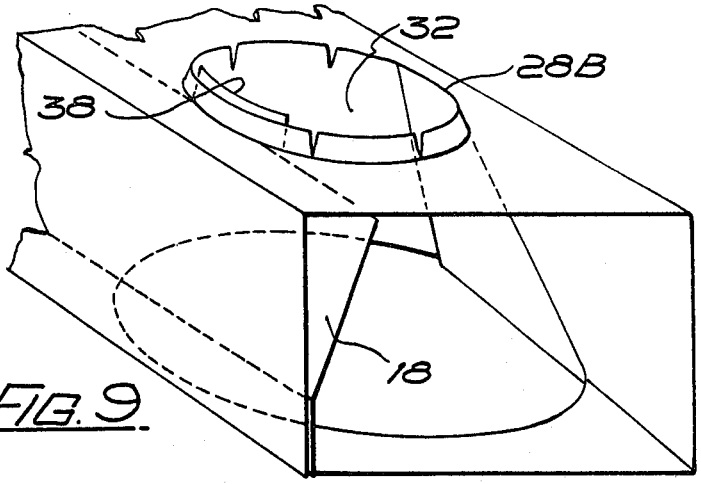
FIG. 9
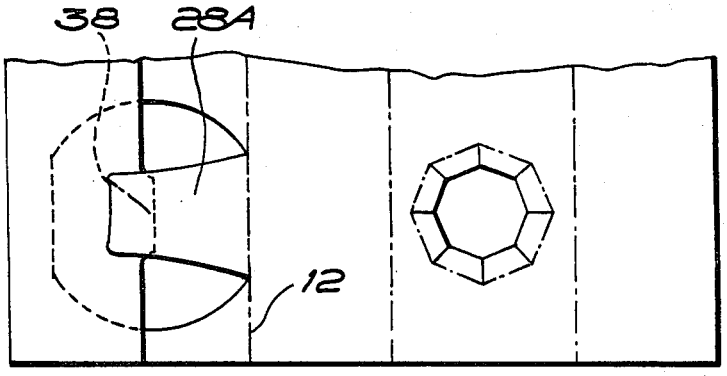
FIG. 10
FIG. 11
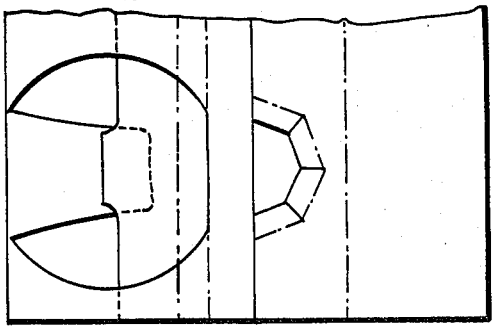

FIG. 31
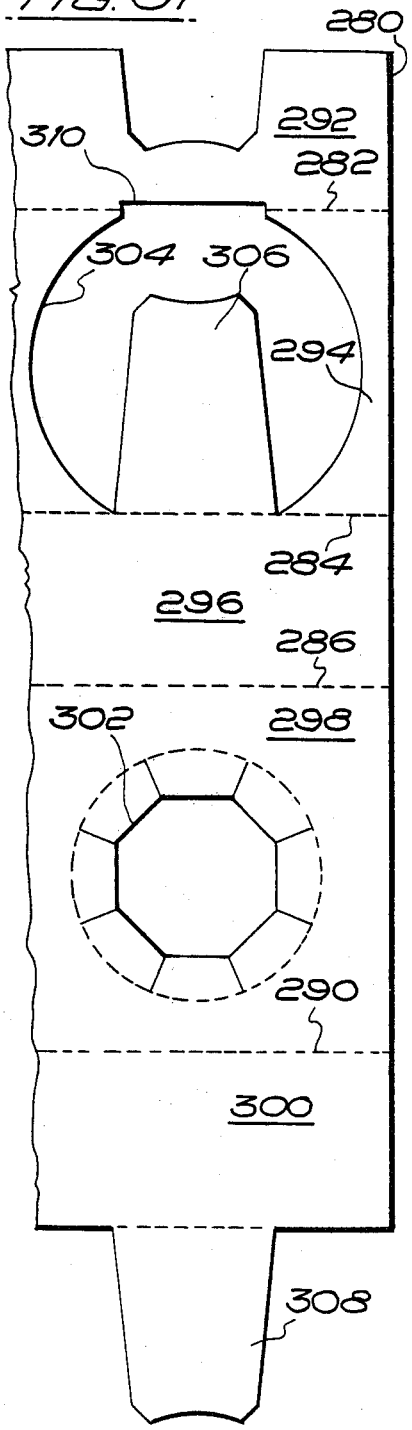
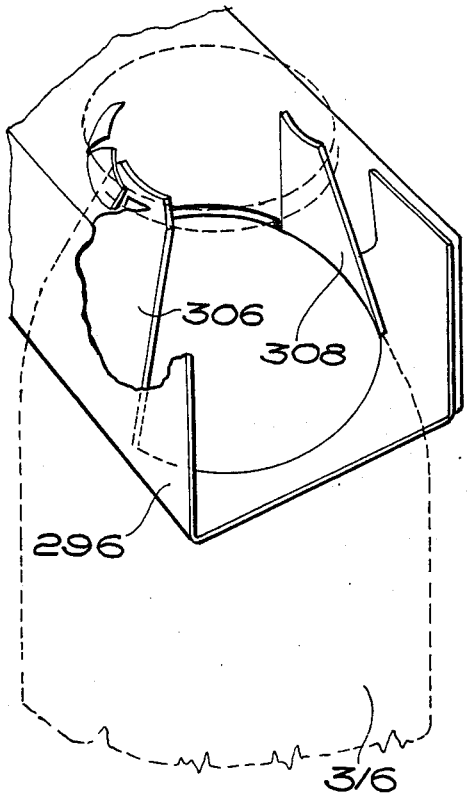
FIG. 32
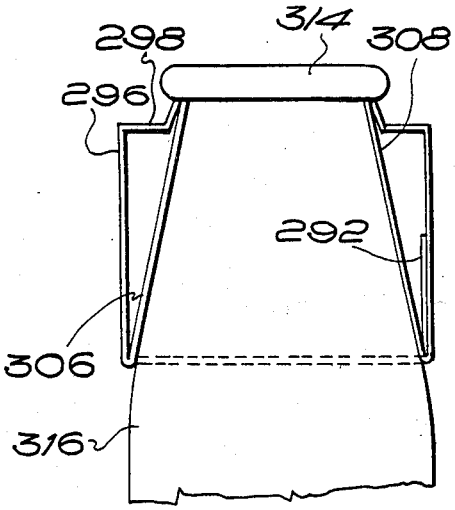
FIG. 33

FIG. 34
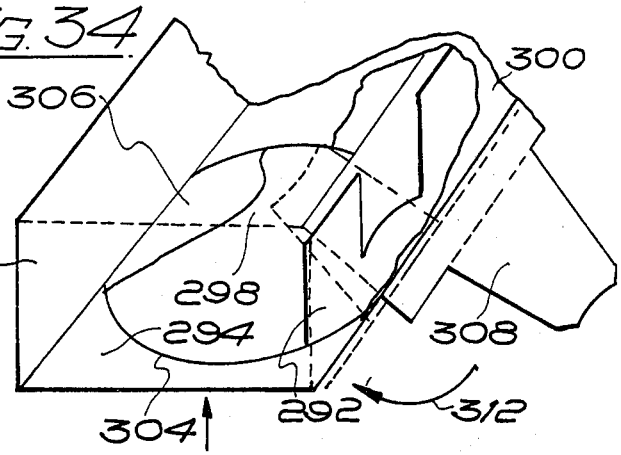
FIG. 35
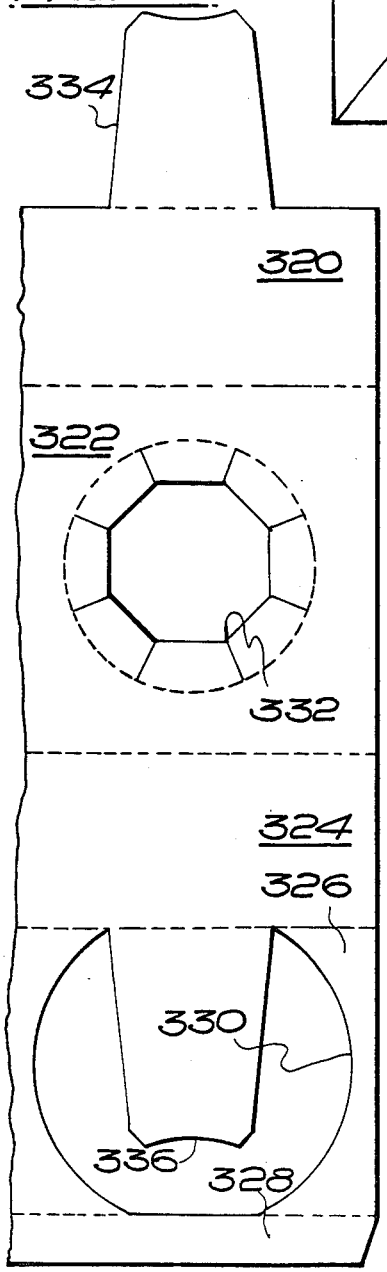
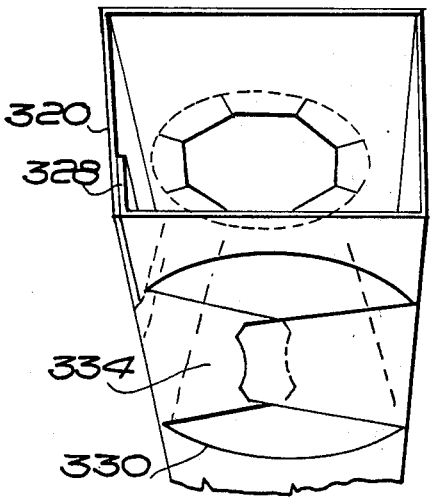
FIG. 36
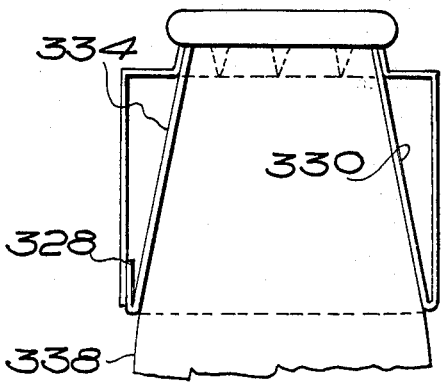
FIG. 37

CARRIERS FOR CONTAINERS

This invention relates to a device for holding together groups of containers, such as bottles which have a mouth portion or cap defining an underside bead or rim which can be engaged by the device, in order that the device will securely hold the bottle in position.

There is already known a device for holding bottles together in this fashion which device is a sleeve adapted to be applied over a group of bottles by a downwards pushing action, accompanied by an inward tucking action of a side wall, the pushing and tucking action together producing a toggle effect which causes the wall to fold and to grip the underside of the bottle rim or bead.

This device requires to be applied by means of a special applicator head which effects the said tucking as well as the pushing.

The present invention relates to devices of the type set forth but in the preferred embodiments of which during application no inward tucking of the side wall is necessary, and by eliminating the toggle action, a much simpler form of head can be used for applying the devices to groups of bottles, because the head can be designed to operate on a straightforward pushing principle.

In accordance with the present invention a device for holding together groups of containers such as bottles, having a mouth portion with an underside rim or bead, or having caps defining underside rims or beads, is produced from cut and creased sheet material and has an upper wall, a side wall, a lower wall, a further side wall and a locking wall and/or locking tabs, the upper wall and lower wall having apertures through which the container top ends can pass so that the mouth portions or caps lie or extend above the upper wall, the locking wall and/or tabs having, on a free edge or edges thereof, top edge portions designed to locate under the said rims or beads to hold the containers in position, and to define with the upper wall and a side wall a triangular shape to ensure the locking of the locking wall in position with the said edge portions locked under the rims or beads of the containers or caps.

By having the said triangular locking arrangement, a considerable rigidifying and locking effect is provided, to ensure that the device will firmly grip the containers.

The said upper wall around the apertures may be provided with fold up tabs which engage the said bead or rim to assist in holding the containers in position, which flaps or tabs fold upwardly as the device is passed over the container top ends, and as the mouth portions pass through the said upper wall apertures.

The side wall of the device remote from the locking wall or locking tabs may also have an inner wall secured thereto with upper edge portions for engaging under the beads or rims in a manner similar to the locking wall, but at the other side of the beads or rims.

The upper wall preferably is hinged to the tops of the said walls along fold lines in the sheet material.

The device is preferably constructed from a one-piece cut and creased blank of sheet material.

The invention can be applied where it is desired to hold containers in single rows of two, three or more or multiple rows of two, three or more in each, to form for example four or six packs of the containers.

Embodiments of the present invention will now be described, by way of example, with reference to the accompanying drawings, wherein:

FIGS. 6 and 7 show in perspective view, a further embodiment of the invention;

FIG. 8 is a plan view of part of a blank according to a further embodiment of the invention;

FIG. 9 shows the blank of FIG. 8 in the erected condition;

FIGS. 10 and 11 show in plan a portion of the blank of FIG. 9, in two partial erection stages thereof;

FIG. 31 shows part of a blank erectable into a device according to a further embodiment of the invention;

FIG. 32 shows, partly broken away, part of the device erected from the blank shown in FIG. 31, when holding a container;

FIG. 33 is an end view of the device and container shown in FIG. 32;

FIG. 34 is an underneath perspective view of the blank of FIG. 31, when partially erected;

FIG. 35 shows part of a blank erectable into a device according to a further embodiment of the invention;

FIG. 36 is an underneath perspective view of part of a device erected from the blank of FIG. 35; and FIG. 37 is an end view of the device shown in FIG. 36 when the containers have been inserted therein.

Figure 1:
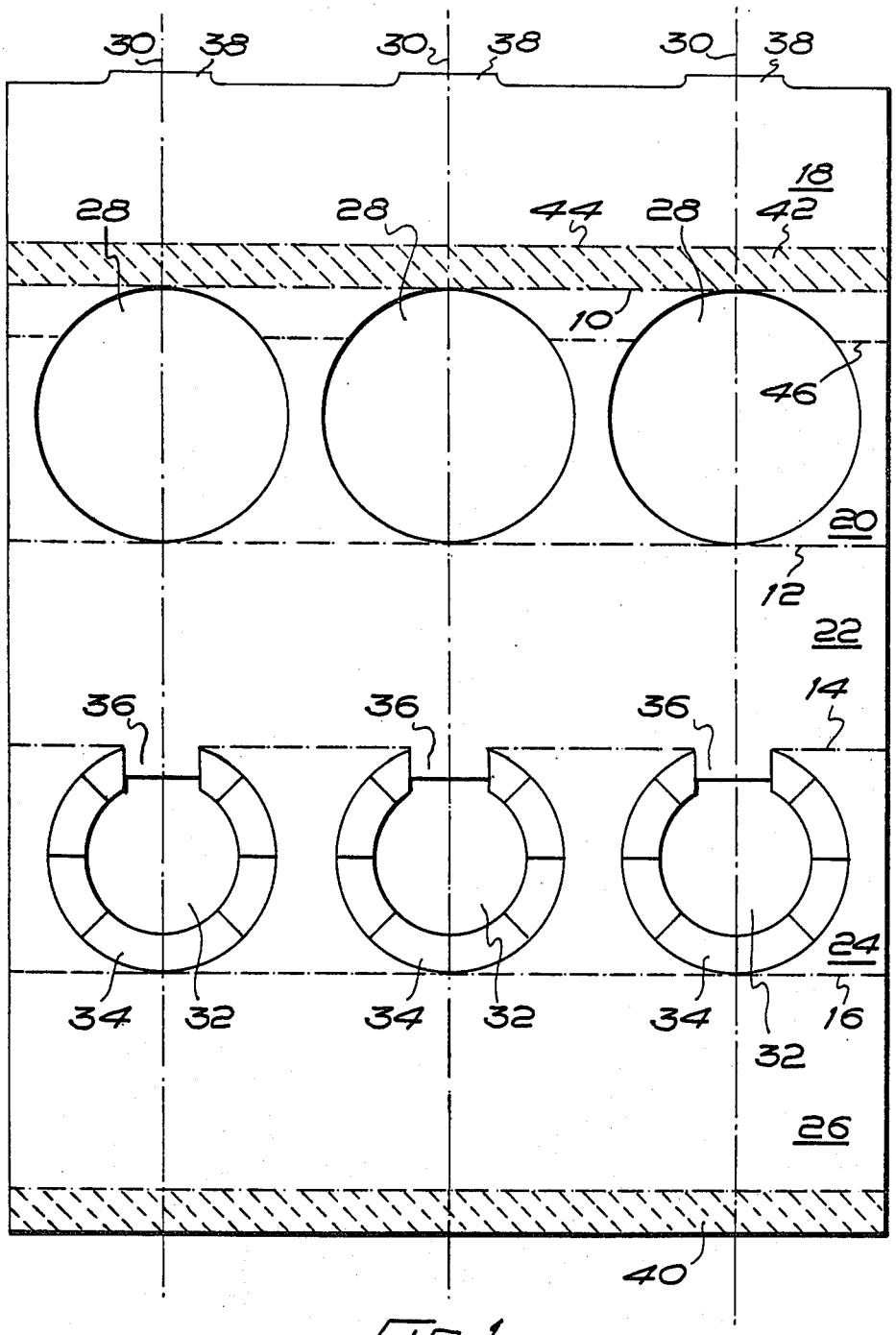
FIG. 1 is a plan view of a blank erectable into a device according to a first embodiment of the invention.

Referring to FIG. 1, the blank shown is formed from cut and creased sheet material such as cardboard, and is generally rectangular in shape. It has transverse crease lines 10, 12, 14 and 16 defining, in a direction from top to bottom, a locking wall 18, a base or lower wall 20, a first side wall 22, a top or upper wall 24 and a second side wall 26. The blank is erectable into a device for holding three containers in a row, and accordingly base 20 is provided with three similar and equally spaced apertures 28, respectively lying on longitudinal centre lines 30. Also lying on the said longitudinal centre lines 30 are apertures 32 in the top panel 24, said apertures being surrounded by fold-up tab portions 34 and projections 36 which are also centered on the lines 30 but in fact project from the panel 22. Similar projections 38 are provided on the free edge of the locking panel 18.

The shaded region 40 of panel 26 is a glue region, and the region 40 is in fact adhered by glue to the shaded region 42 of the panel 18. The boundary line 44 of the locking panel 18 may in fact also be a crease line.

Figure 2:
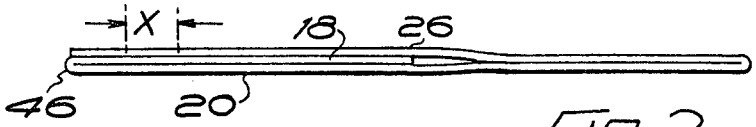
FIG. 2 shows the blank of FIG. 1 when folded to flattened skillet form.

Finally, the panel 20 is provided with a crease line 46, the purpose of which is to enable the blank to be folded to the flattened condition shown in FIG. 2, and the regions 40 and 42 adhered, by means of conventional folding and gluing equipment of the in-line variety.

Figure 3:
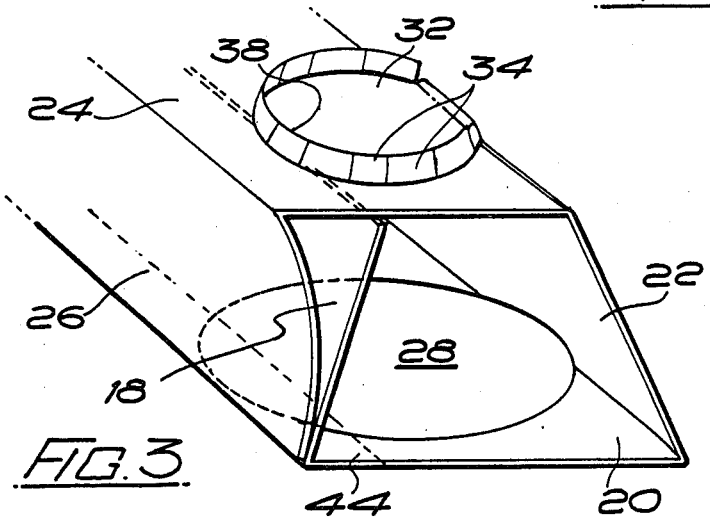
FIG. 3 shows an end portion of the device of FIG. 2 in perspective view, when erected.
Figure 4:
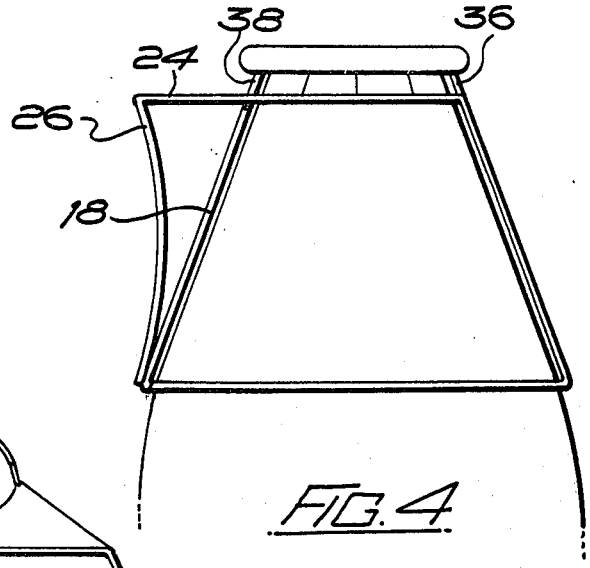
FIG. 4 shows the device of FIG. 3 in end view after application to the containers for which it is designed.

Moving from FIG. 1 to FIG. 2, in order to erect the blank shown in FIG. 1, it is first of all folded about line 46, and then about line 14, bringing the regions 40 and 42 into overlapped condition as indicated by reference X in FIG. 2. It is to be noted that the locking wall 18 is located between the base 20, and the side wall 26. To erect the flattened sleeve of FIG. 2 fully, the flattened sleeve is folded until the position illustrated in FIG. 3 is reached. In this figure, it is to be noted that the locking panel 18 takes up an inclined disposition symmetrical to the inclined disposition of the wall 22, whilst the wall 26 together with a portion of the top wall 24 and the wall 18 form a triangular configuration which, as is well known, gives excellent strength and rigidity characteristics. The apertures 32 and 28 come into alignment, and the projections 36 and 38 become opposed, and in fact lie under or extend inside the flaps 34. To apply the erected sleeve shown in FIG. 3, it is simply a matter of bringing the three containers to be held thereby into alignment, and pushing the device down over the container tops, until the containers are engaged by the device as shown clearly in FIG. 4, in which the projections 38 and 36 engage under the container bead thereby locking it to the device. The triangular arrangement formed by wall 26, top 24 and locking wall 18 serves to hold the container rigidly to the device, and the device can be applied by a simple pushing action.

Figure 5:
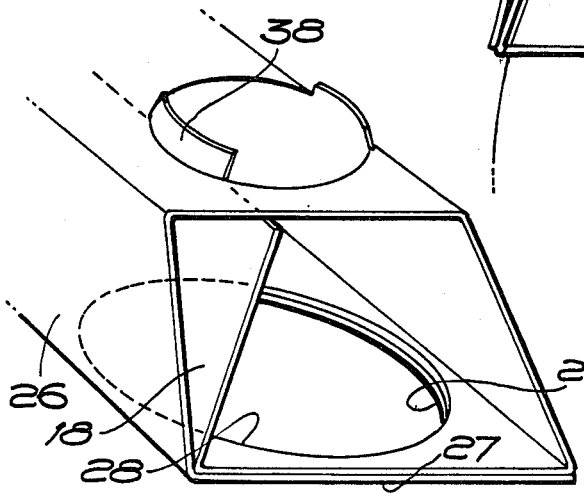
FIG. 5 shows in perspective view similar to FIG. 3, a further embodiment of the invention.

In the arrangement shown in FIG. 5, instead of the wall 26 being glued to the locking wall 18, the lower edge of wall 26 is hinged to a secondary base wall 27, provided with apertures 29 which align with the apertures 28, and the projection of the container through the aligned apertures 27 and 29 ensures that the wall 26 is held firmly in position forming the said triangular strengthening feature as referred to herein.

In the arrangement according to FIG. 6, a four sided sleeve is provided, which has a base 60, a first side wall 62, a top wall 64, and a further side wall 66, the panels being connected by a glue flap 68. The base 60 is provided with apertures 70, but the material to define the apertures is removed selectively so as to leave a locking flap 72. The top wall 64 is provided with the aligned apertures 74 and side wall 62 is provided with locking projections 76. Fold up tabs 78 surround the apertures 74. The panel 66 is longer than the panel 62, so that the cross sectional length of panel 62 plus the cross sectional length of base 60 equals the cross sectional length of panel 66 plus the cross sectional length of top wall 64, whereby the sleeve can be folded to flattened skillet form, about the crease lines 80 and 82, whereby an additional crease line such as crease line 46 is not necessary. Because of this geometrical arrangement, the top wall 64 is, in the erected condition, in inclined disposition.

When the sleeve is applied to the containers by a downwards pushing on the top panel 64, in the first place the locking flap 72 is moved upwardly to the position shown in FIG. 7, in which the top edge of the locking flap engages under the container bead or rim in a manner similar to projection 76. At the same time the top panel 64 is displaced into a disposition in which it is parallel to the base panel 60 and this causes the said panel 66 to bow outwardly, as shown clearly in FIG. 8. The tops of the containers pass through the apertures 74, and the locking tabs 78 engage under the container rim, locking the sleeve in position, and the residual outward bowing of the material induces a stress loading on the sleeve which acts to keep the locking tab 72 and the projection 76 firmly locked under the container bead or rim.

Referring now to FIGS. 8 to 12, in FIG. 8 there is shown a portion of a blank for erection into a device according to another embodiment of the invention. The portion shown is an end portion and shows sufficient to indicate the parts of the blank able to hold one container. It will be appreciated that the blank is, similar to the blank of FIG. 1, for holding multiple containers, and indeed the blank of FIG. 8 is very similar to the blank of FIG. 1, except that an additional tongue 28A is provided in each aperture 28 and the crease line 44 is provided. Otherwise, the blank is basically the same, and the same reference numerals have been used for equivalent parts.

A further difference from the FIG. 1 embodiment, is that the panels 20 and 24 are of the same width, so that the resulting outer shape of the erected sleeve as shown in FIG. 9, is rectangular, and the sleeve can be moved to flattened skillet form by folding about a pair of diagonally opposite creases.

The tongue 28A functions as a locking member by engaging under the container rim or bead, in a similar fashion to the projection 38 of panel 18.

In order to erect the blank shown in FIG. 8, first of all the tabs 28A are deflected upwardly about fold line 12 out of the plane of the blank, and then the panel 18 is folded inwardly about its crease line 44, so that, as shown in FIG. 10, the projection 38 lies to the underside of the tab 28A. This ensures that the tab 28A is kept in a position in which it will not interfere with the subsequent folding of the blank. In the next stage of erection, the blank is folded about crease line 12 to the position shown in FIG. 11 in which the panel 18 and the panel 20 are folded onto the panels 22 and 24. Next, the panel 26 is folded about a crease line 16, so that its free edge region overlies the bridge between crease lines 10 and 44 of panel 18 to which the said free edge is adhered by suitable adhesive.

Figure 12:
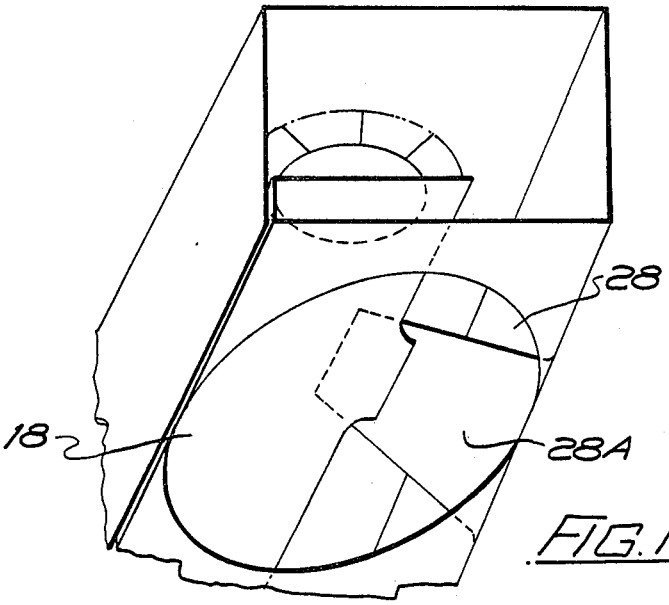
FIG. 12 is an underneath perspective view of the erected blank prior to the insertion therein of the containers to be held thereby.

When the thus formed sleeve is moved to the erected condition shown in FIG. 12, prior to insertion through the aperture 28 of the container to be held, the panel 18 and its opposite locking tab 28A overlap as shown, but are inclined inwardly by virtue of the erection operation described, so that when a container top is pushed into the aperture 28, the panel 18 and locking tab 28A are deflected against their natural resilience to the position shown in FIG. 9, in which they are upwardly inclined, and in relation to which the locking top edges 38 and 28B lie in the aperture 32, until the locking projections 38 and 28 are locked under the container rim or cap to lock same firmly and securely in position. Reference to FIG. 9 will show that a triangular reinforcing arrangement is achieved at each side of the sleeve giving an extremely firm locking effect on the container, preventing it from dropping out of the bottom of the sleeve. It will be appreciated that the sleeve will be designed for holding two or more containers in similar fashion.

Figure 13:
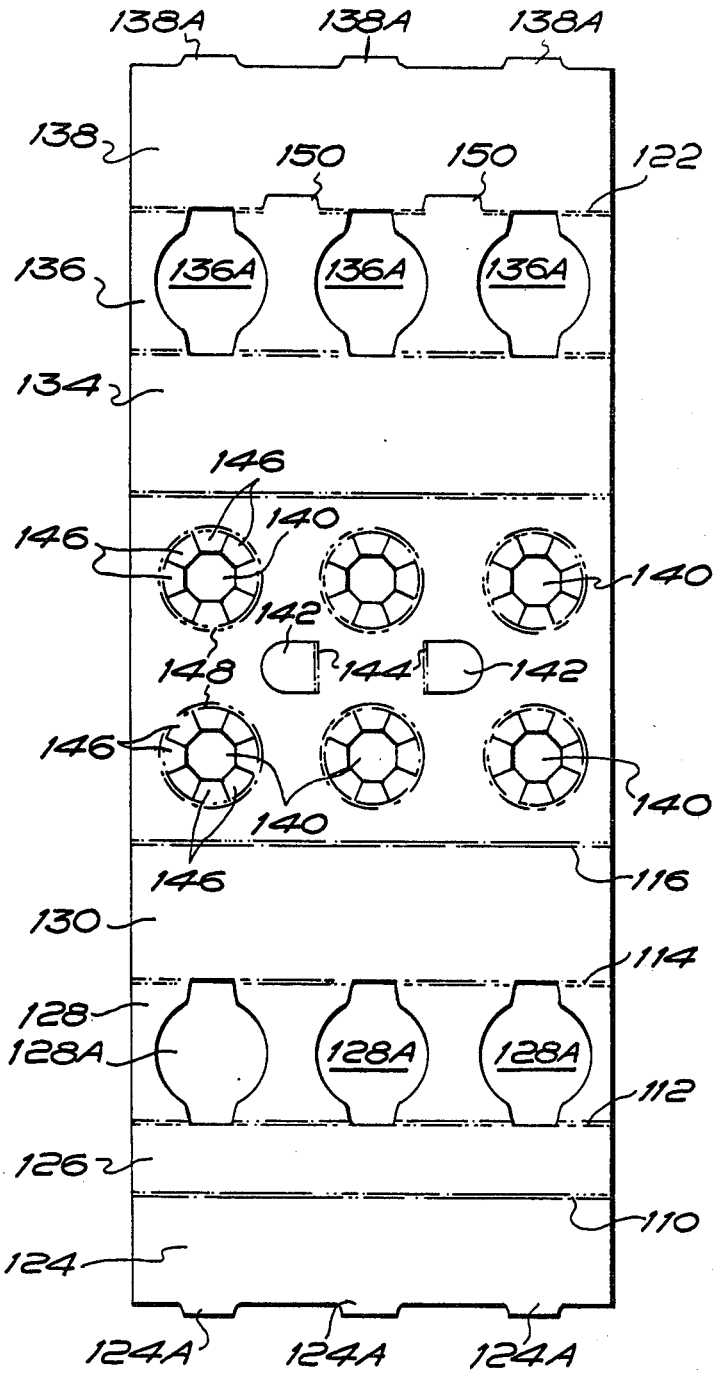
FIG. 13 shows a plan view of a cut and creased blank erectable into a carrier for holding six containers.

In FIG. 13 there is shown a blank of cut and creased sheet material, such as cardboard, the cut lines being indicated by full lines, and the crease lines being indicated by chain dotted lines.

The blank is of elongated rectangular form, and transverse crease lines 110, 112, 114, 116, 118, 120 and 122, divide the blank into eight transverse panels, 124, 126, 128, 130, 132, 134, 136 and 138. End panels 124 and 138 are each provided with three locking projections 124A and 138A, which are evenly and symmetrically disposed in relation to the longitudinal axis of the blank.

Panels 128 and 136 are provided with cut lines defining three tongues 128A and 136A.

Panel 132 is provided with six regularly spaced apertures 140 which are arranged in two rows each of three apertures, and cuts in panel 132 define two flaps 142 which can be deflected downwardly about crease lines 144 to provide engagement apertures for the thumb and one finger to enable the erected carrier and the containers it holds to be lifted.

Each aperture 140 is defined by a plurality of holding tongues 146 which can deflect upwards, as will be explained, about the surrounding crease lines 148. Apertures defined in this manner have become known in the trade as "sunbursts" in that the tabs 146 tend to burst upwards as the containers are inserted, as will be appreciated.

Finally, the crease line 122 is broken by means of two restraining tabs 150, which in fact are part of panel 136, but extend into panel 138.

Figure 14:
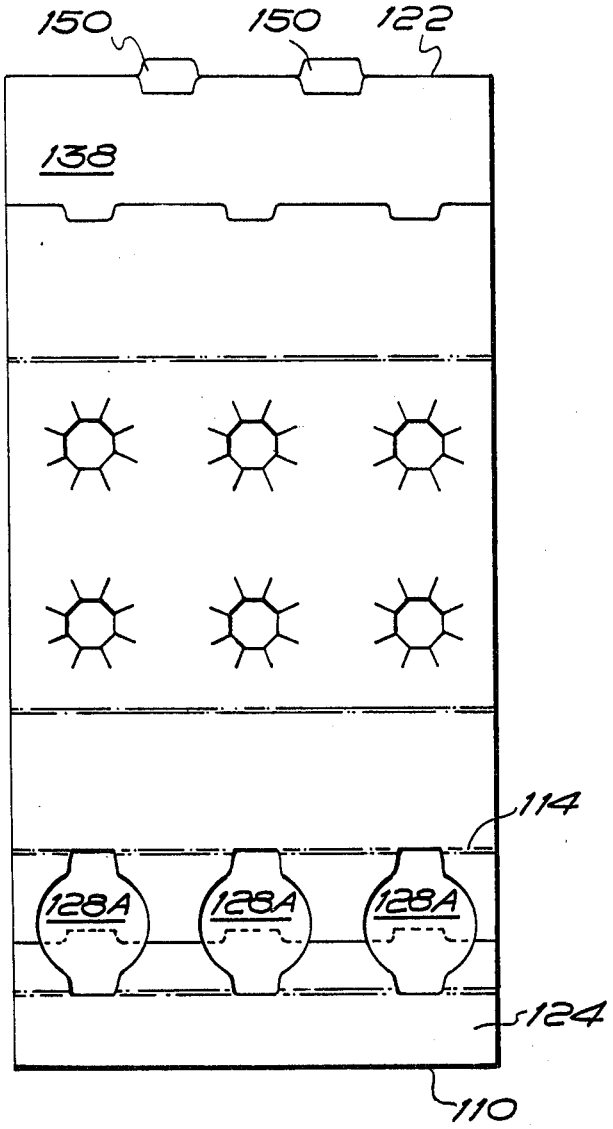
FIGS. 14, 15 and 16 show the respective stages in the erection of the blank shown in FIG. 13 to fold it to and glue it in flattened skillet form.
Figure 16:
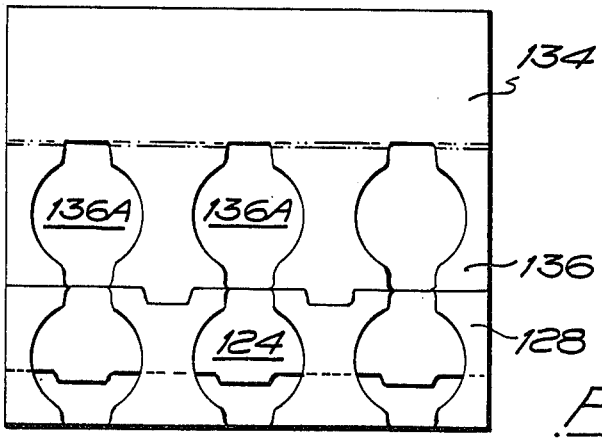

In order to fold the blank of FIG. 13 to the flattened skillet form shown in FIG. 16, the following sequence of operations takes place. Firstly, the tongues 128A are deflected upwards so as to pivot about the hinge line 114, and then the panel 125 is folded about hinge line 110, so that panel 124 locates under the upwardly displaced tongues 128A. Next, the panel 138 is folded about line 122 so that the position illustrated in FIG. 14 is achieved. It is to be noted that the restraining projections 150 protrude outwardly from the fold line 122 in the FIG. 14 position.

Figure 15:
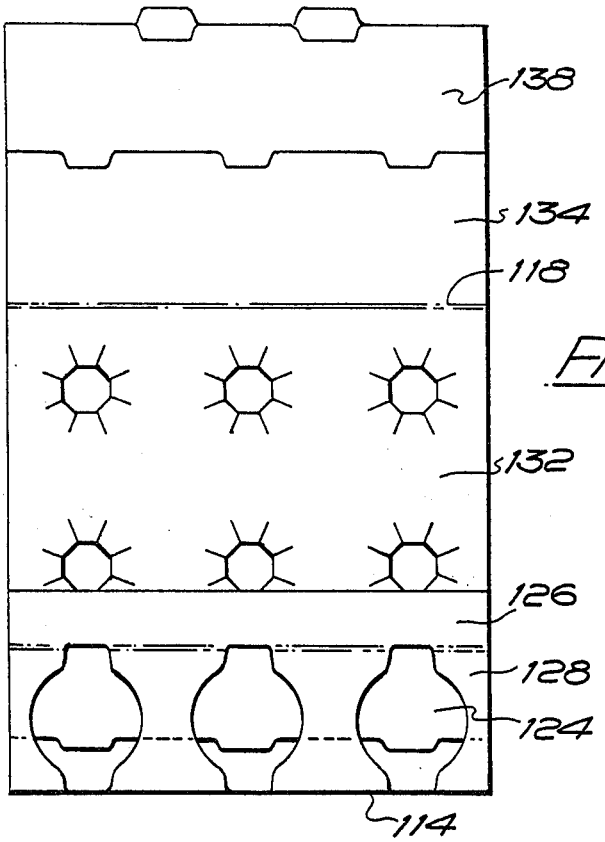

In the next stage of folding, the blank is folded about hinge line 114 so that panels 128 and 126 lie uppermost as shown in FIG. 15, with panel 124 lying between panel 128 and panel 130.

Figure 17:
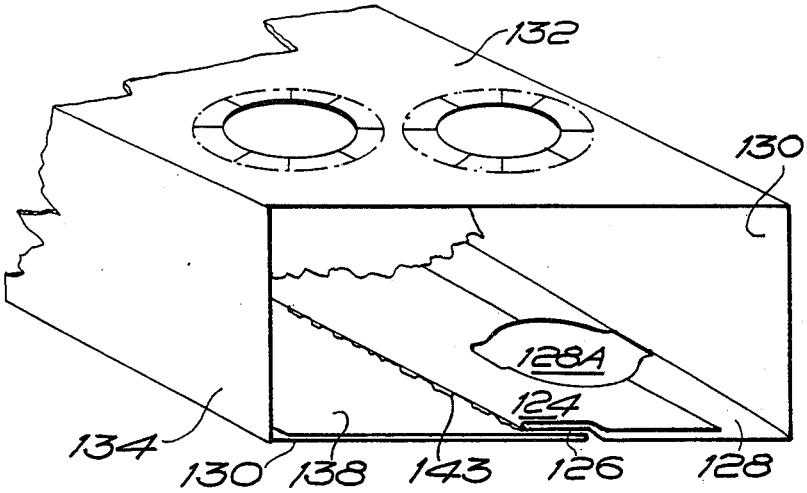
FIG. 17 shows an end of the carrier of FIG. 13 after erection from the flattened skillet form, and before receiving the containers.

Finally, as shown in FIG. 16, the blank is folded about hinge line 118 so that panels 134 and 136 as well as the already folded over panel 38 are caused to overlap panel 132 and panel 126. Adhesive is applied to one or other surface of the overlap region defined by panel 126 and the portion of panel 138 which lies opposite panel 126 and such adhesive, applied by any suitable conventional means holds the folded over portions of the blank together. FIG. 16 shows the blank in flattened skillet form, and if reference is now made to FIG. 17, the blank is shown in the erected condition, the adhesive glue seam being indicated by numeral 142 in FIG. 17. FIG. 17 shows also how the tongues 128A overlie the panel 124.

Figure 20:
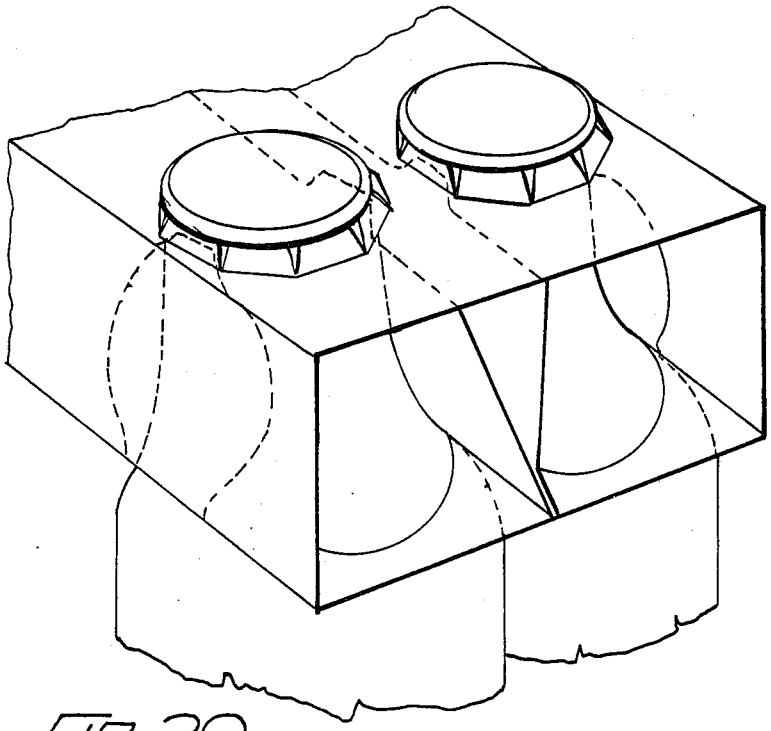
FIG. 20 is a perspective view of an end of the carrier of FIG. 13 with the containers in the fully home position.
Figure 18:
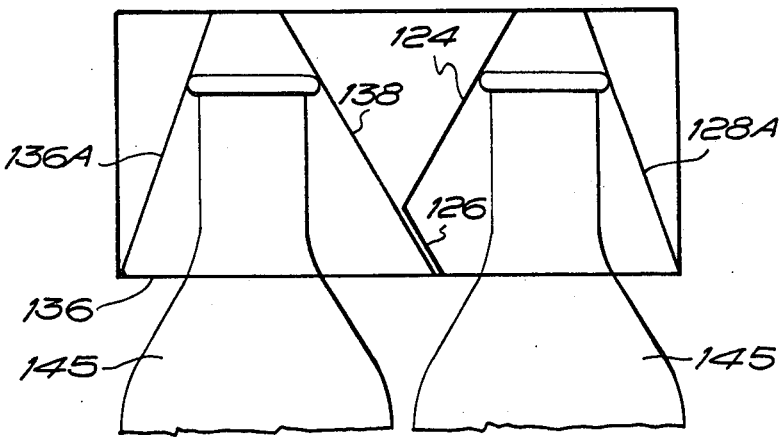
FIG. 18 is an end view of the carrier of FIG. 13 when erected, and following initial insertion of the containers from the underside of the carrier.
Figure 19:
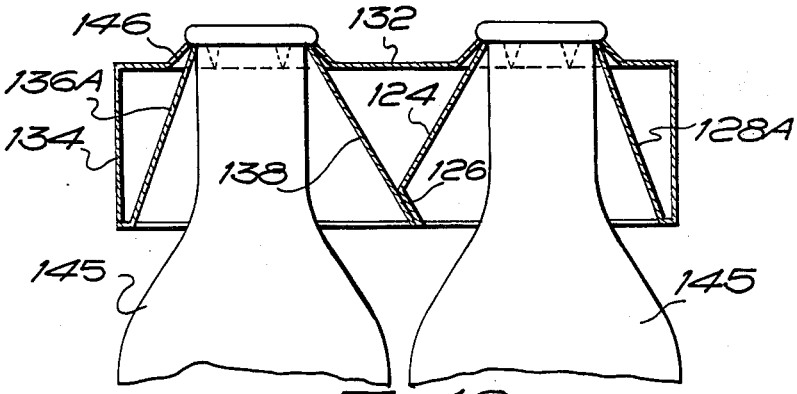
FIG. 19 is a section end view of the carrier of FIG. 13, showing the containers in the fully home position.

When the erected panel is in the condition shown in FIG. 17,, it is ready to be applied to the containers, in this case bottles, to be held by the carrier. If reference is now made to FIG. 18, the carrier is shown in end elevation after initial application of the carrier to six bottles arranged in two rows of three. It is to be appreciated that only two bottles are visible in the figure. The bottles are represented by numeral 145. The carrier is applied by relative downwards movement of the carrier over the bottle tops as shown in FIG. 18, so that the bottle tops register with the tongues 136A on the one hand, and the apertures left by the displacement of the tongues 128A on the other hand, and continued movement of the carrier relative to the bottles 145 causes the panels 124 and 138 and the tongues 136A and 128A to erect as shown in FIG. 18 so that the projections 124A and 138A and also the tips of the tongues 128A and 136A register with the apertures 140. Continued relative displacement of the bottles and the carrier resultss in the tops of the bottles pushing through the apertures 140, displacing the tongues 146 and trapping the projections 124A and 130A and also trapping the tips of the tongues 128A and 136A under the bottle tops as shown clearly in FIG. 19, whereby the bottles become firmly locked to the carrier, and in this regard it should be mentioned that the apertures left by the displacement of the tongues 128A and 136A are dimensioned to the regions of the bottle shoulders which will be engaged by the carrier to ensure a firm and secure grip of the bottles. FIG. 20 shows the arrangement in perspective elevation, and it is of course to be mentioned that this figure shows only two bottles, but in fact the carrier will hold six bottles in two rows of three.

With the construction described, an extremely firm locking effect is achieved on the containers, enabling them to be held together in a group until such times as the bottles are to be used when they can be physically burst from the carrier. The carrier may be provided with appropriately positioned tear strips to ensure easy removal of the containers.

It can be seen easily that the arrangement described with reference to FIGS. 13 to 20 can be modified easily so as to hold four containers in a square array.

Figure 21:
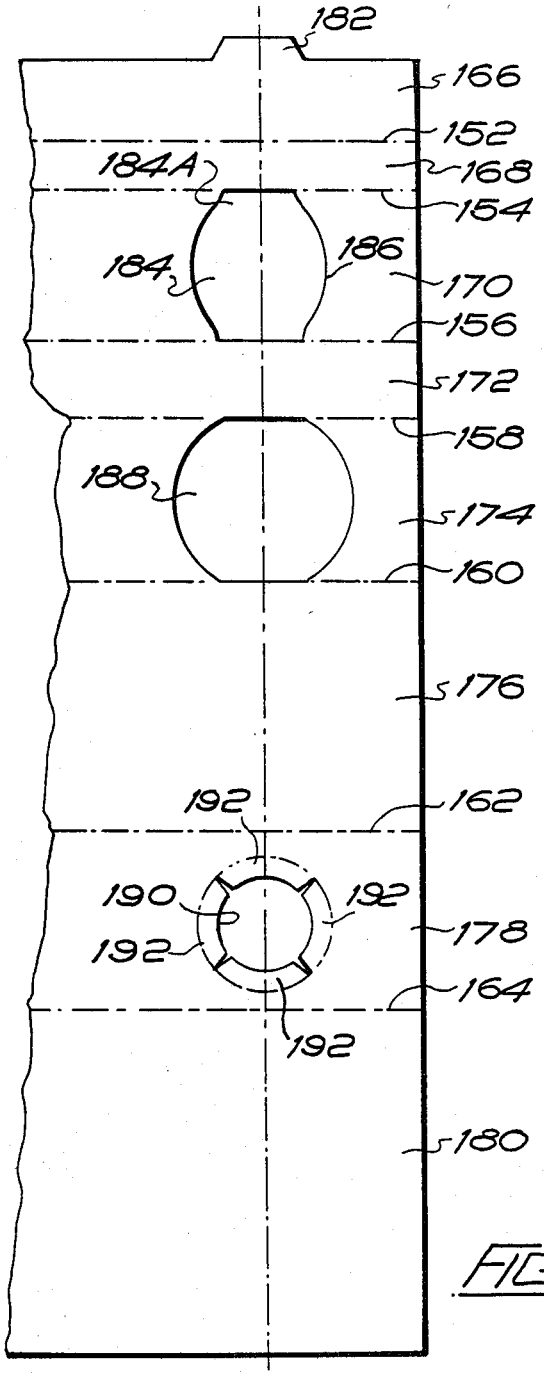
FIG. 21 is a view similar to FIG. 8, showing in plan a portion of a blank erectible into a device according to a still further embodiment of the invention.
Figure 22:
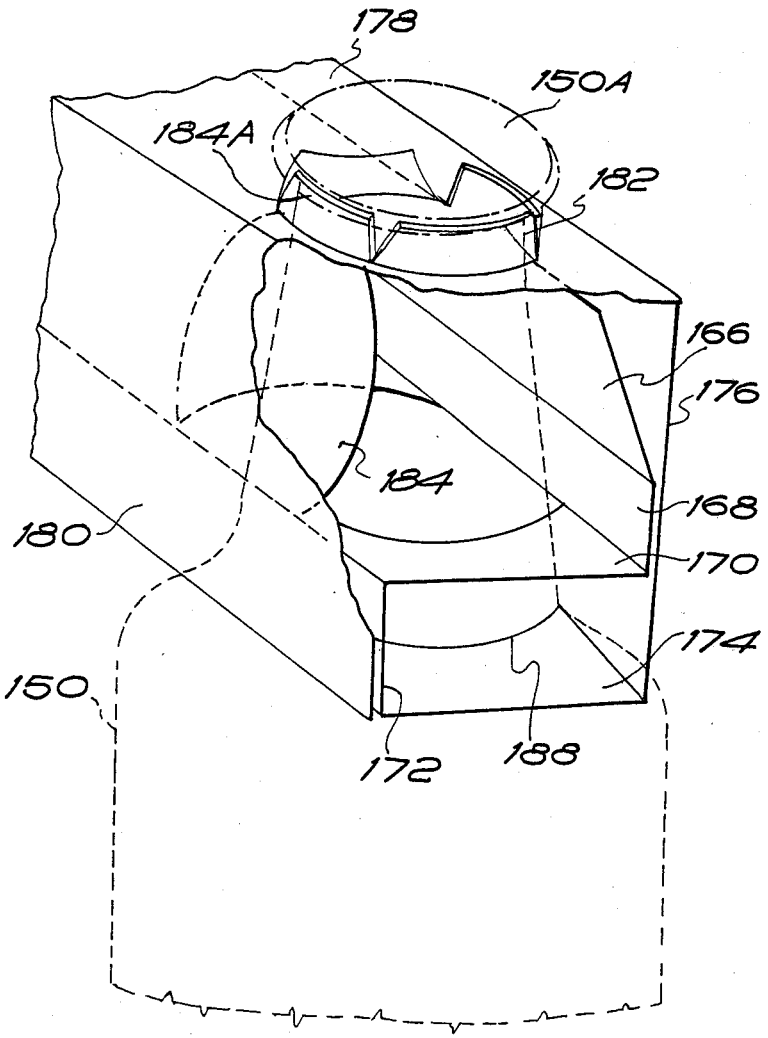
FIG. 22 is a perspective view showing a portion of the device erected from the blank of FIG. 21, with a container shown in gripped position.

Referring to FIGS. 21 and 22, these Figs. illustrate a device according to the invention which is usable in connection with bottles having a relatively long and narrow neck portion. One such bottle is illustrated by numeral 150 in FIG. 22. FIG. 22 also shows the device according to the embodiment in erected condition, whilst FIG. 21 shows an end portion of the blank which is erectible into the device. Referring specifically to FIG. 21, the blank is a rectangular sheet of cardboard provided with transverse crease lines 152, 154, 156, 158, 160, 162, 164, defining panels 166, 168, 170, 172, 174, 176, 178 and 180. The edge panel 166 is provided with locking protrusions 182, panel 166 as will be clear from FIG. 22 forming a locking wall, whilst panel 170 is provided with tongues 184 formed by making cuts 186 in the panel 170 to define apertures on receiving the bottle neck as again will be explained in relation to FIG. 22. Panel 174 is provided with bottle neck receiving apertures 188, whilst panel 178, which forms the upper or top panel is provided with apertures 190 surrounded by sunburst tabs 192. In this case there are four tabs 192 surrounding each aperture 192.

Reference is best made to FIG. 22 to show how the blank of FIG. 21 is folded to the erected condition. The panel 180 is an outer vertical side wall, which leads upwardly to the top wall 178. The panel 176 is the other outer side wall and extends downwardly from the top wall to the second lower wall 174 having the apertures 188. The wall 172 is located to the inside of wall 180 and extends upwardly, wall 172 being glued to the inside of wall 180. Wall 170 is the horizontally extending first lower wall, and wall 168 extends upwardly to the inside of the side wall 176 and is glued thereto. Finally the locking wall 166 extends upwardly and inwardly in an inclined fashion so that the projecting tabs 182 project through the apertures 190 in the upper wall 178. The Fig. shows the bottle 150 in position, and it will be seen that the tongue 184 has been deflected upwardly so that its end portion 184A extends into the aperture 192 and locks under the cap 150A of the bottle and locks the bottle in position in exactly the same manner as in embodiments previously described herein.

The advantage of this particular embodiment is that the reference point of the locking wall 166 and locking tabs 184 is raised to the level of wall 170, whereas for example in the embodiment of FIG. 8, the reference point for pivoting is at the lower wall equivalent to the position indicated by wall 174 in FIG. 22. FIG. 22 also shows that the tabs 192 deflect upwardly and also lock under the bottle cap 150A.

Figure 23:
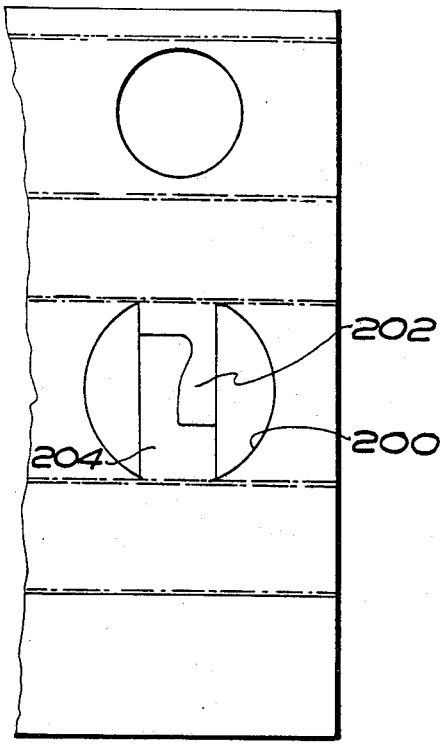
FIGS. 23 and 24 are views similar to FIGS. 21 and 22, showing a further embodiment of the invention.
Figure 24:
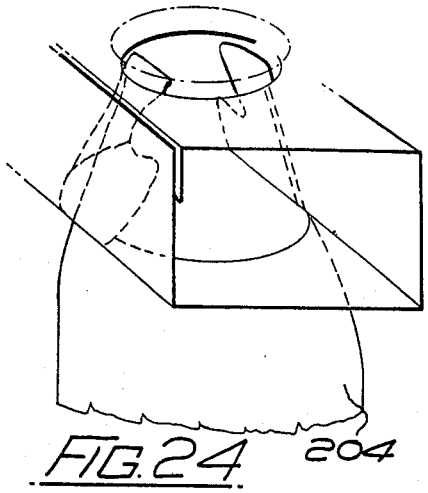

In a modified form of the invention shown in FIGS. 23 and 24, in each base wall aperture 200, two locking tabs 202 and 204 are defined and these tabs as shown in FIG. 24 lock on the underside of the container cap. In this embodiment no locking wall is necessary.

Figure 26:
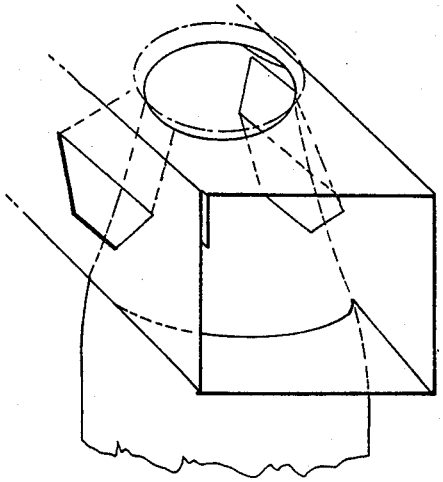
FIGS. 25 and 26 are views similar to FIGS. 21 and 22 showing a further embodiment of the invention.
Figure 25:
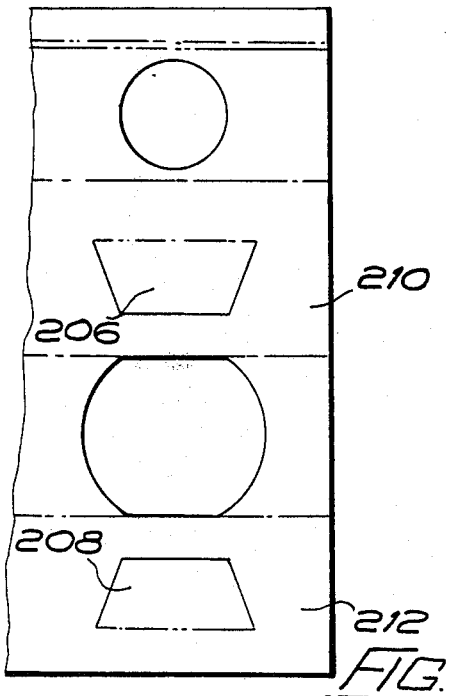
Figure 27:
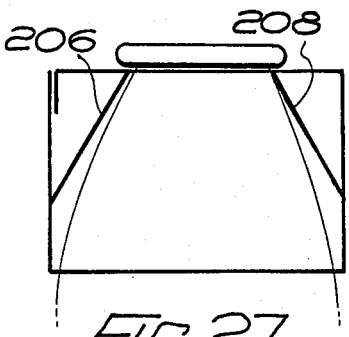
FIG. 27 is an end view of the device shown in FIG. 26, when in erected condition.

In the arrangement shown in FIGS. 25, 26 and 27, the locking tabs 206 and 208 are formed in the respective side walls 210 and 212, and the tabs are folded inwardly and upwardly as shown in FIGS. 26 and 27 to lock on the underside of the bottle cap. In this embodiment no locking wall or locking tabs deflected out fo the base aperture are necessary.

Figure 29:
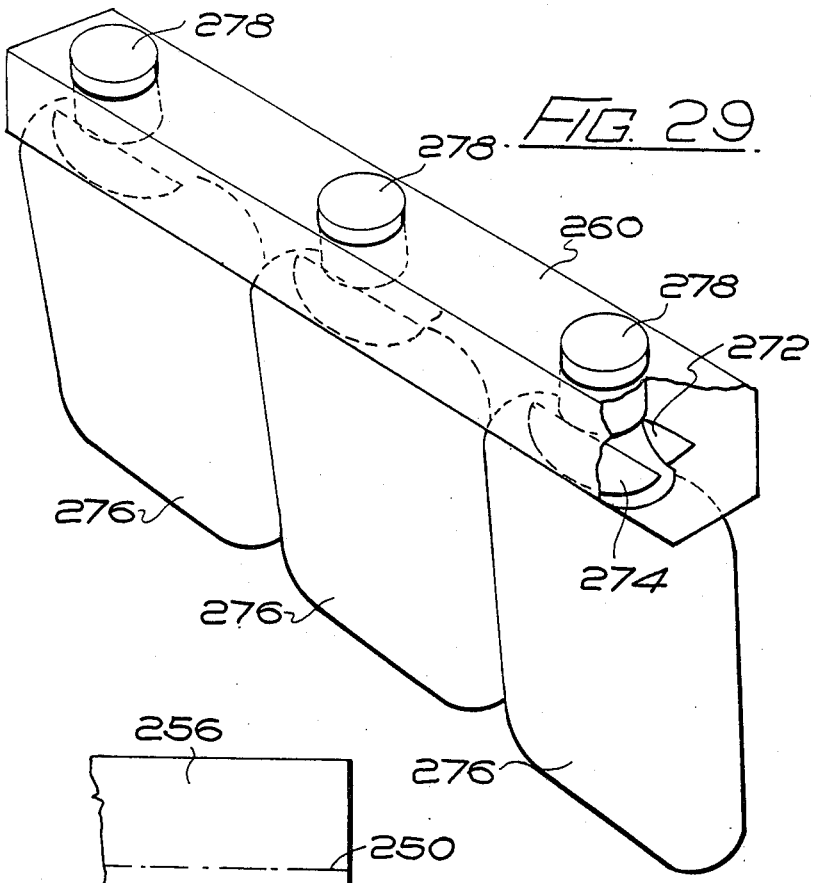
FIG. 29 is a perspective view, partly broken away, of a device erected from the blank which is partly shown in FIG. 28, with the containers held thereby.
Figure 28:
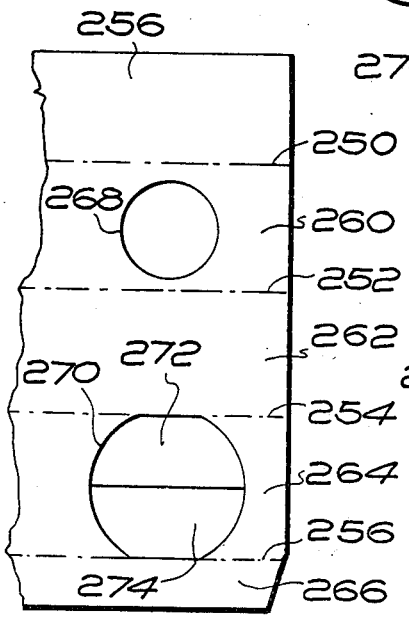
FIG. 28 shows part of a blank erectable into a device according to a further embodiment of the invention.
Figure 30:
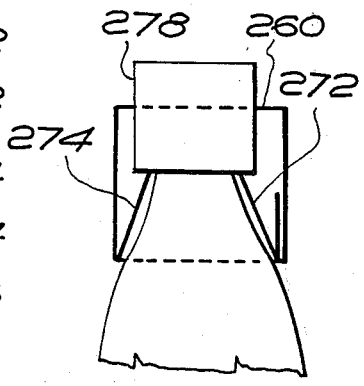
FIG. 30 is an end view of the device and containers shown in FIG. 29.

Referring to FIGS. 28 to 30, in FIG. 28 there is shown part of a blank erectable into a gripper sleeve as shown in FIGS. 29 and 30. The portion of the blank shown indicates that the blank has crease lines 250, 252, 254 and 256 defining a side panel 258, a top panel 260, a further side panel 262, a lower panel 264 and a glue tab 266. The top panel 260 has plain circular apertures 268, whilst the base panel 264 has apertures 270 defined by cuts so that there are defined two semi-circular locking panels 272 and 274. It will be appreciated that in the full blank there are a plurality of the aperture pairs 268 and 270. The blank is folded to square section by gluing tab 266 to the inside of panel 258, and the square section sleeve is applied to containers 276 as shown in FIG. 29 by pushing the sleeve over the container caps 278, so that the caps 278 project through the apertures 268, and the locking flaps 272 and 274 and deflect inwardly and upwardly so as to lock to the underside of the caps 278 as shown clearly in FIG. 30. It can be seen therefore that the blank operates on the same principle as indicated herein in that the locking tabs 274 and 272 engage to the underside of the cap 278 which projects through the top panel 260. A firm locking effect is achieved, and the containers 276 can be removed only by bursting the carrier sleeve. Turning now to FIGS. 31 to 34, again only a portion of a blank 280 is shown. The blank shown is adapted to be erected into sleeve form without requiring the use of any gluing, and the erected sleeve interacts with the containers to be gripped in order on the one hand to grip the containers, and on the other hand to ensure that the containers help maintain the sleeve in the erected condition. The blank has fold lines 282, 284, 286 and 290 defining panels 292, 294, 298 and 300. The panel 298 is a top panel and is provided with suburst apertures 302, whilst the base panel 294 has apertures 304. Within aperture 304 is defined a locking tongue 306 in the same manner as hereinbefore described whilst on the free edge of panel 300 there are further locking tongues 308 of the same dimension as the tongues 306. The aperture 304 has a profile edge region 310 for location of the locking flap 308 which is in alignment therewith, as will be explained. To erect the blank of FIG. 31, reference is best made to FIG. 34 which is an underside perspective view of an end of the partially erected blank. The panels 292 and 294 are folded to lie at right angles, as are panels 296 and 298 so as to define the rectangular box section as shown. The remaining panel 300 is folded to the outside of panel of 292, and the tongues 308 are finally folded inwardly as indicated by arrow 312 in FIG. 34 until the tongues 306 and 308 project inwardly relative to the aperture 304. When the container top is pushed into aperture 304, the tongues 306 and 308 take up the locking positions shown in FIG. 33 in which the tops of the tongues engage the underside of the cap 314 of the container 316. The panel 292 becomes trapped between the inwardly turned tongue 308 and the panel 300, thereby maintaining the erection of the blank. FIG. 32 shows in perspective cut-away elevation how the tongues 306 and 308 are positioned for the locking of the container 316. Referring now to FIGS. 35 and 36, the blank illustrated in FIG. 35 when erected into a sleeve is adapted to operate in a somewhat similar fashion to that illustrated in FIGS. 31 to 34. The blank has creases defining a side panel 320, top panel 322, a further side panel 324, and a base panel 326. There is a glue tab 328 at the free edge of the base panel 326, and panel 326 has container receiving apertures 330, whilst top 322 has sunburst apertures 332 for the purpose already explained herein. The free edge of panel 320 has locking tongues 334 and in removing the sheet material to define apertures 330, there are left locking tongues 336. The blank of FIG. 35 is erected by folding and by gluing the glue tab 328 to the inside of panel 320 as shown clearly in FIG. 36. The locking tabs 334 are folded so as to lie across the apertures 330 as shown in FIG. 36, so that by insertion of the container 338 to the position as shown in FIG. 37, the tongues 334 and 330 are deflected inwardly to the locking position shown in FIG. 37, which corresponds to the locking position shown in FIG. 33. The embodiments of FIGS. 31 to 37 have the advantage that there is no possibility of the erected container coming apart in the region of the glue flap 328 in the case of the FIGS. 35 to 37 embodiment, or in the region of the lower edge of wall 229 in the FIGS. 31 to 34 embodiment, because both said wall 229 and glue tab 328 are trapped between the inwardly turned tongue 334 and 308, and the side wall 320 or 300 as the case may be.

It can be seen that the invention can take many forms and other, not described, modifications are possible within the scope of the present invention.

We claim:

1. A device for holding together groups of containers such as bottles that have a mouth portion with an underside rim or bead, or having caps defining underside rims or beads, which device is produced from cut and creased sheet material which has an upper wall, a first side wall, a lower wall spaced below said upper wall, a second side wall spaced apart from said first side wall, and a locking member, the improvement comprising (1) said lower wall and said upper wall each having apertures through which the top ends of the container can pass so that the mouth portions or caps of the containers extend above said upper wall, (2) said locking member (a) having a base portion that is hingedly connected to some portion of the device at a point below said upper wall, (b) having an upper edge portion that is adapted to extend from a point beneath upper wall upwardly and under the rim or bead of a container, and (c) being positioned so that it diverges inwardly and upwardly with respect to the sidewall closest to its base portion so that the relationship between said upper wall, said locking member and the side wall nearest the locking member closely approximates that of a triangle, thus ensuring locking of the upper edge portion of the locking member under said rims or beads.

2. A device according to claim 1 wherein the locking member comprises tabs which are formed out of the material which initially lies in the apertures in the lower wall, and such tabs are folded upwards and inwards by movement of the device over the tops of the containers, and the tops of said locking tabs project into the apertures in the upper wall when in the locking position.

3. A device according to claim 1 or 2 wherein the device is for holding a single row of aligned containers, and the locking member comprises locking tabs which lie in the apertures in the lower wall, and there is an inner locking wall which is adhered to the inside of one of the side walls, but has a free edge defining locking projections, and when the device is passed over the row of containers the said locking tabs and inner locking wall are displaced to the inclined locking positions by folding relative to the respective side walls, and in which position the locking tabs and projections of the inner locking wall engage under the container caps, rims or beads.

4. A device according to claim 3 wherein the device is constructed from a single blank of cut and creased sheet material including a number of parallel panels, which blank can be folded and glued to a flattened skillet form, and when erected is of rectangular square cross section.

5. A device according to claim 4 wherein the said locking tabs in the folded condition of the blank lie behind the inner locking wall to prevent same from projecting outwardly of the folded and flattened device.

6. A device according to claim 1 or 2 wherein the device has a first lower wall and a second lower wall located below the first lower wall, the first and second lower walls having apertures for receiving the containers, the locking tabs extending from the first lower wall to the upper wall.

7. A device according to claim 1 or 2 wherein the device is for holding two parallel rows of containers, and the lower wall and upper wall have parallel rows of aligned apertures, and there are locking tabs in the respective lower wall apertures which fold upwardly and engage under the rims of the respective rows of containers, the locking edges lying in the apertures in the upper wall in the locked position.

8. A device according to claim 7 wherein there are two locking walls which are glued together and which lie between the rows of the containers when held by the device, the said locking walls having locking projections which respectively engage under the rims or beads of the caps or container mouths when held by the device, said locking walls being arranged to lie at an angle to the container axis.

9. A device according to claim 8 wherein the device is formed from a cut and creased blank of sheet material.

* * * * *